US009556767B2

(12) United States Patent
Newman et al.

(10) Patent No.: US 9,556,767 B2
(45) Date of Patent: Jan. 31, 2017

(54) INTAKE MANIFOLD PORTS AND PCV PASSAGES INTEGRATED INTO CAM COVER

(71) Applicant: Ford Global Technologies, LLC, Dearborn, MI (US)

(72) Inventors: Christopher William Newman, Farmington Hills, MI (US); Claude Weston Bailey, III, Warren, MI (US); Scott Morton, New Boston, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/457,600

(22) Filed: Aug. 12, 2014

(65) Prior Publication Data

US 2016/0047283 A1 Feb. 18, 2016

(51) Int. Cl.

| | |
|---|---|
| ***F01M 13/04*** | (2006.01) |
| ***F02F 7/00*** | (2006.01) |
| ***F01M 13/02*** | (2006.01) |
| ***F02M 35/10*** | (2006.01) |
| *F01M 13/00* | (2006.01) |

(52) U.S. Cl.

CPC ..... *F01M 13/0405* (2013.01); *F01M 13/023* (2013.01); *F01M 13/028* (2013.01); *F01M 13/0416* (2013.01); *F02F 7/006* (2013.01); *F02M 35/10222* (2013.01); *F01M 13/0011* (2013.01)

(58) Field of Classification Search

CPC .... F01M 13/00; F01M 13/04; F01M 13/0405; F01M 13/0416; F01M 13/028; F02F 7/006; F02M 35/10209; F02M 35/10222; F02M 35/10242; F02M 35/10255; F02M 35/10262

USPC ..... 123/572, 574, 41.86, 184.22, 184.53

See application file for complete search history.

(56) References Cited

U.S. PATENT DOCUMENTS

| | | | | | |
|---|---|---|---|---|---|
| 4,602,607 | A * | 7/1986 | Balsley | F01M 13/023 | 123/41.86 |
| 4,637,367 | A * | 1/1987 | Hatakenaka | F01M 13/025 | 123/572 |
| 4,651,704 | A * | 3/1987 | Sekiguchi | F01L 1/047 | 123/572 |
| 4,922,881 | A * | 5/1990 | Tamba | F01M 13/04 | 123/572 |
| 5,129,371 | A | 7/1992 | Rosalik | | |
| 6,178,939 | B1 * | 1/2001 | Powell | F02B 67/06 | 123/184.21 |
| 6,435,170 | B1 * | 8/2002 | Hamelink | F01M 13/04 | 123/572 |
| 6,662,791 | B2 * | 12/2003 | Nakamizo | F01M 13/0011 | 123/572 |

(Continued)

*Primary Examiner* — Grant Moubry

(74) *Attorney, Agent, or Firm* — LeClairRyan

(57) ABSTRACT

An internal combustion engine having manifold ports and positive crankcase ventilation (PCV) passages integrated into the cam cover is disclosed. The engine system comprises a cam cover having an internal, gas-passing passage, a PCV valve associated with the passage, an oil separator associated with the PCV valve, and an intake manifold having a port, the port being associated with the PCV valve. An oil separator is fitted between the gas-passing passage and the PCV valve. The oil separator is mounted on the cam cover. A manifold chamber is also provided and the PCV oil separator is associated with the manifold chamber.

17 Claims, 4 Drawing Sheets

(56) References Cited

U.S. PATENT DOCUMENTS

| | | | | |
|---|---|---|---|---|
| 7,143,754 | B2 * | 12/2006 | Girard | F01M 13/022 123/572 |
| 7,316,226 | B2 * | 1/2008 | Callahan | F02M 25/06 123/572 |
| 8,118,013 | B2 * | 2/2012 | Arvan | F01M 13/0405 123/184.47 |
| 8,464,698 | B2 * | 6/2013 | Durkin | F01M 13/022 123/184.21 |
| 8,511,291 | B2 | 8/2013 | Hirano et al. | |
| 8,590,506 | B2 * | 11/2013 | Lee | F02B 17/005 123/299 |
| 8,662,025 | B2 * | 3/2014 | Taki | F02F 1/242 123/41.32 |
| 2002/0023631 | A1 * | 2/2002 | Ito | F01L 1/02 123/572 |
| 2007/0261684 | A1 | 11/2007 | Hazelton et al. | |
| 2009/0266326 | A1 | 10/2009 | Durkin et al. | |
| 2010/0108013 | A1 * | 5/2010 | Lee | F02B 17/005 123/188.8 |
| 2010/0313860 | A1 * | 12/2010 | Miller | F01M 11/02 123/573 |
| 2012/0132158 | A1 | 5/2012 | Park | |
| 2012/0199095 | A1 * | 8/2012 | Bryde | F02F 7/006 123/195 C |

* cited by examiner

INTAKE MANIFOLD PORTS AND PCV PASSAGES INTEGRATED INTO CAM COVER

TECHNICAL FIELD

The disclosed inventive concept relates to positive crankcase ventilation (PCV) systems for internal combustion engines. More particularly, the disclosed inventive concept relates to an internal combustion engine having intake manifold ports and PCV passages integrated into the cam cover, thus resulting in both PCV separation and distribution being completely contained within the cam cover.

BACKGROUND OF THE INVENTION

During the combustion stage of the air-fuel mixture within an internal combustion engine, exhaust gases are created that exit the engine via the exhaust manifold during engine operation. However, not all gases exit the engine at this time. Some of these gases are forced to bypass the piston and enter the crankcase because of the pressure created during combustion of the air-fuel mixture.

Relief of these collected gases is necessary to avoid damage to engine gaskets caused by the extra crankcase pressure. Such damage resulted in oil leakage. An early and direct solution to the build-up of exhaust gases in they crankcase was simply to exhaust the collected gases directly to the atmosphere via, for example, a road draft tube. However, this is an undesirable solution to the presence of these gases due to the negative environmental impact generated by these unburned hydrocarbon emissions.

As an alternative, these gases can be re-introduced into the engine by evacuating them from the crankcase and adding them to the air-fuel mixture entering the engine via the intake manifold. A typical solution has been to have the crankcase gases flow from the crankcase to the intake manifold by way of a positive crankcase ventilation ("PCV") system as regulated by a valve located along the PCV path.

According to one PCV example, the path for the PCV begins at the valve cover and ends at the intake manifold. During engine operation, the PCV valve increases a restriction between the intake system and the crankcase during periods of higher intake manifold vacuum, thus reducing the restriction between the intake manifold and the crankcase during periods of lower intake manifold vacuum. According to this system, a slight vacuum is maintained in the engine crankcase thereby drawing hydrocarbons from the engine crankcase and directing them into the engine intake system.

Known systems rely on a PCV valve typically fitted to the valve cover. An external PCV hose is fitted between the air/oil separator and the intake manifold. Hose connections may also include a hose connection on the cam cover and one on the intake manifold. Joints are required for each connection. While providing an environmentally sound method of relieving the collected gases, the reliance on rubber hoses introduces potential failure of the system due to aging of the hoses or leakage caused by accidental disconnection of the hose from the valve. In addition, the current combination of known intake manifold designs and known PCV systems can ingest an unequal distribution of water in the form of vapor trapped within the crankcase gases that can result in combustion performance and risk of freezing of the throttle plate in the throttle body.

Accordingly, as in so many areas of vehicle technology there is room for improvement related to the use and operation of PCV systems associated with the internal combustion engine.

SUMMARY OF THE INVENTION

The disclosed inventive concept overcomes the problems associated with known positive crankcase ventilation (PCV) system designs by providing an internal combustion engine having intake manifold ports and PCV passages integrated into the cam cover. The disclosed inventive concept offers the significant general advantage of completely containing both PCV separation and distribution within the cam cover.

Particularly, the disclosed inventive concept integrates a cam-cover-mounted oil separation system that removes oil from crankcase gases in which the PCV pathways lead directly to the intake manifold ports through internal passages formed in the cam cover. The integral lower intake runners are molded directly into the cam cover. The crankcase gases are thus ported into some or all of the intake runners. The PCV flow of crankcase gases is managed with an integrated flow valve into the cam cover.

The disclosed inventive concept eliminates the challenge of determining the ideal PCV entrance in the intake plenum to ensure equal distribution to all runners. This solution eliminates the cost of a PCV hose assembly and eliminates the joints which contribute to evaporative emissions, thus reducing the number of components and reducing overall engine and vehicle weight. In addition, because the disclosed inventive concept retains the heat of crankcase gases longer, it prevents water vapor from condensing, thus avoiding the reduction of combustion performance associated with known systems by reducing the tendency for crankcase gas moisture to accumulate in the intake plenum and near the throttle body. The disclosed inventive concept also eliminates accumulation of PCV-borne water and ice in the intake manifold.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
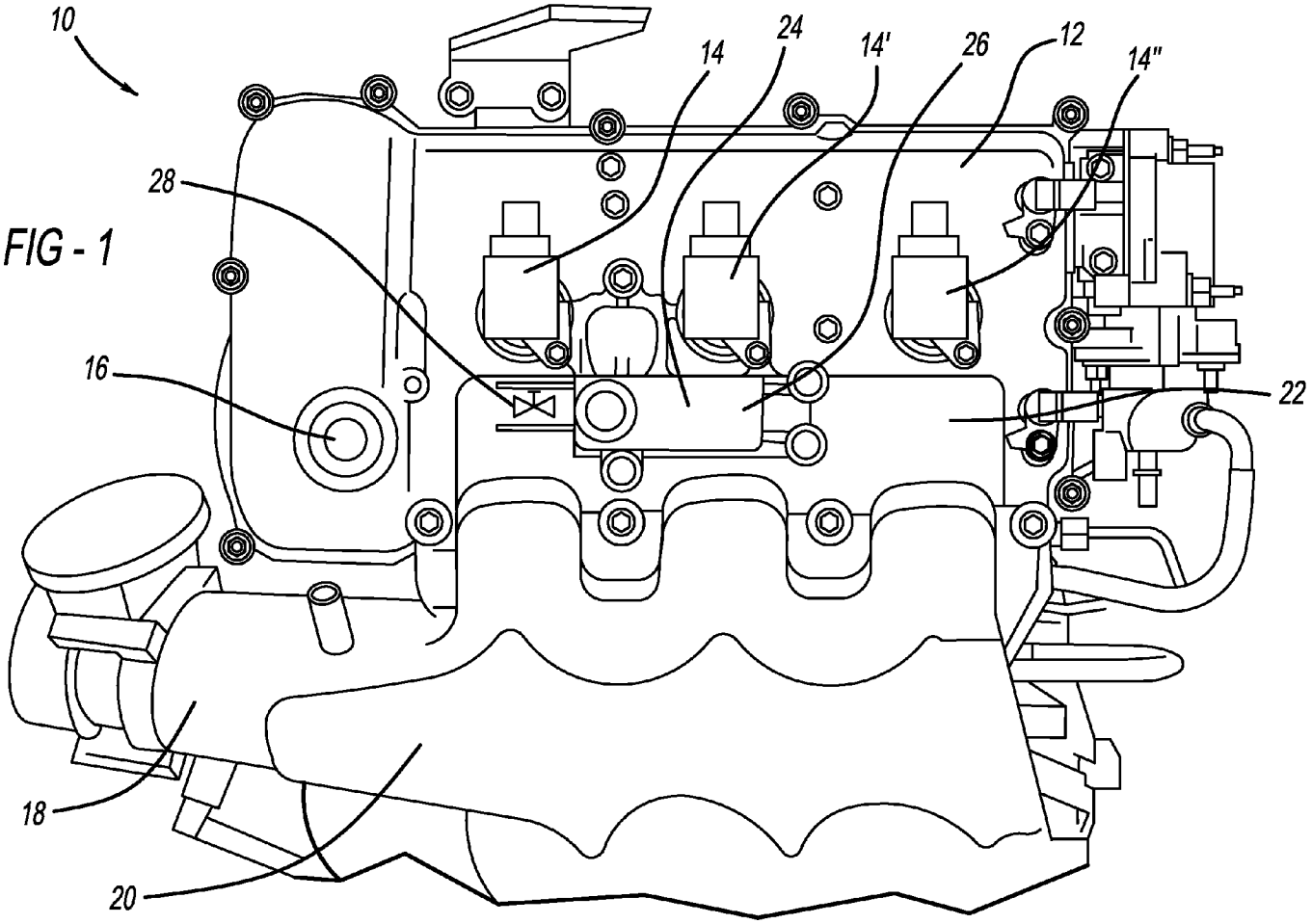
FIG. 1 is a plan view of an internal combustion engine having a cam cover having integrated positive crankcase ventilation (PCV) passages according to the disclosed inventive concept.

In the following figures, the same reference numerals will be used to refer to the same components. In the following description, various operating parameters and components are described for different constructed embodiments. These specific parameters and components are included as examples and are not meant to be limiting.

In general, the disclosed invention is related to directing crankcase gases from the crankcase of an internal combustion engine and into the intake manifold for combustion through the use of intake manifold ports and positive crankcase ventilation (PCV) passages integrally formed in the cam cover. The disclosed inventive concept provides a cam cover within which both PCV separation and distribution are completely contained.

The internal combustion engine illustrated in the figures is only intended as being suggestive and is not intended as being limiting as the disclosed inventive concept may find application with any internal combustion engine. Variations of the illustrated configuration may be envisioned without deviating from the concept.

Referring to FIG. 1, an internal combustion engine 10 is illustrated. A cam cover 12 is provided. The overall shape of the cam cover 12 is intended as being illustrative and is not intended as being limiting.

The internal combustion engine 10 may comprise any number of cylinders and the number illustrated is only suggestive. As illustrated, the internal combustion engine 10 includes a first ignition on plug arrangement 14, a second ignition on plug arrangement 14', and a third ignition on plug arrangement 14". An oil fill port 16 is shown formed on the cam cover 12.

The internal combustion engine 10 includes an intake assembly 18 is fitted to the internal combustion engine 10 adjacent the cam cover 12. The intake assembly 18 includes an intake manifold 20.

A manifold chamber 22 is formed generally between the cam cover 12 and the intake manifold 20. The manifold chamber 22 defines an enclosed volume. An oil separation system 24 is associated with the manifold chamber 22. The oil separation system 24 separates oil from crankcase gases. The oil separation system 24 includes a PCV oil separator 26 and a PCV regulator valve 28.

Figure 2:
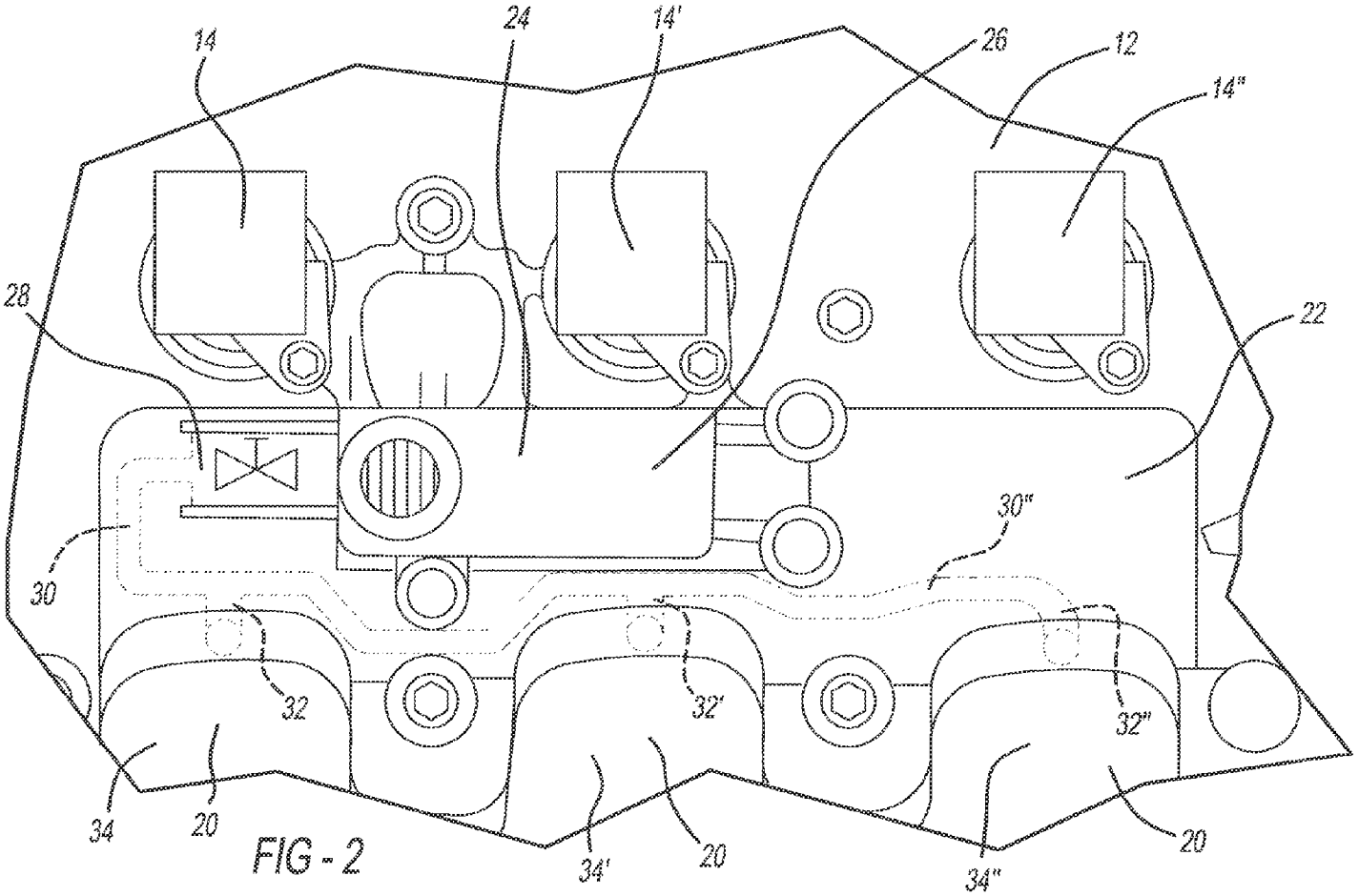
FIG. 2 illustrates a close-up view of a portion of the internal combustion engine illustrated in FIG. 1 in which the PCV intake runner ports and the intake runners are illustrated in broken lines according to one embodiment of the disclosed inventive concept.

Referring to FIG. 2, a close-up view of a portion of the internal combustion engine 10 is illustrated according to one embodiment of the disclosed inventive concept. The manifold chamber 22 is associated with the PCV regulator valve 28 such that an intake runner port directs gases from the crankcase to one or more intake runners. The arrangement of intake runner ports may be any of a number of possible scenarios, one of which is illustrated in FIG. 2. A PCV intake runner manifold 30 is connected to the output side of the regulator valve 28. The PCV intake runner manifold 30 has PCV intake runner ports 32, 32' and 32" branching therefrom. The PCV intake runner port 32 is associated with an intake runner 34. The PCV intake runner port 32' is associated with an intake runner 34'. And the PCV intake runner port 32" is associated with an intake runner 34". The PCV intake runner manifold 30 and the PCV intake runner ports 32, 32' and 32" are integrally formed within the cam cover 12.

Figure 3:
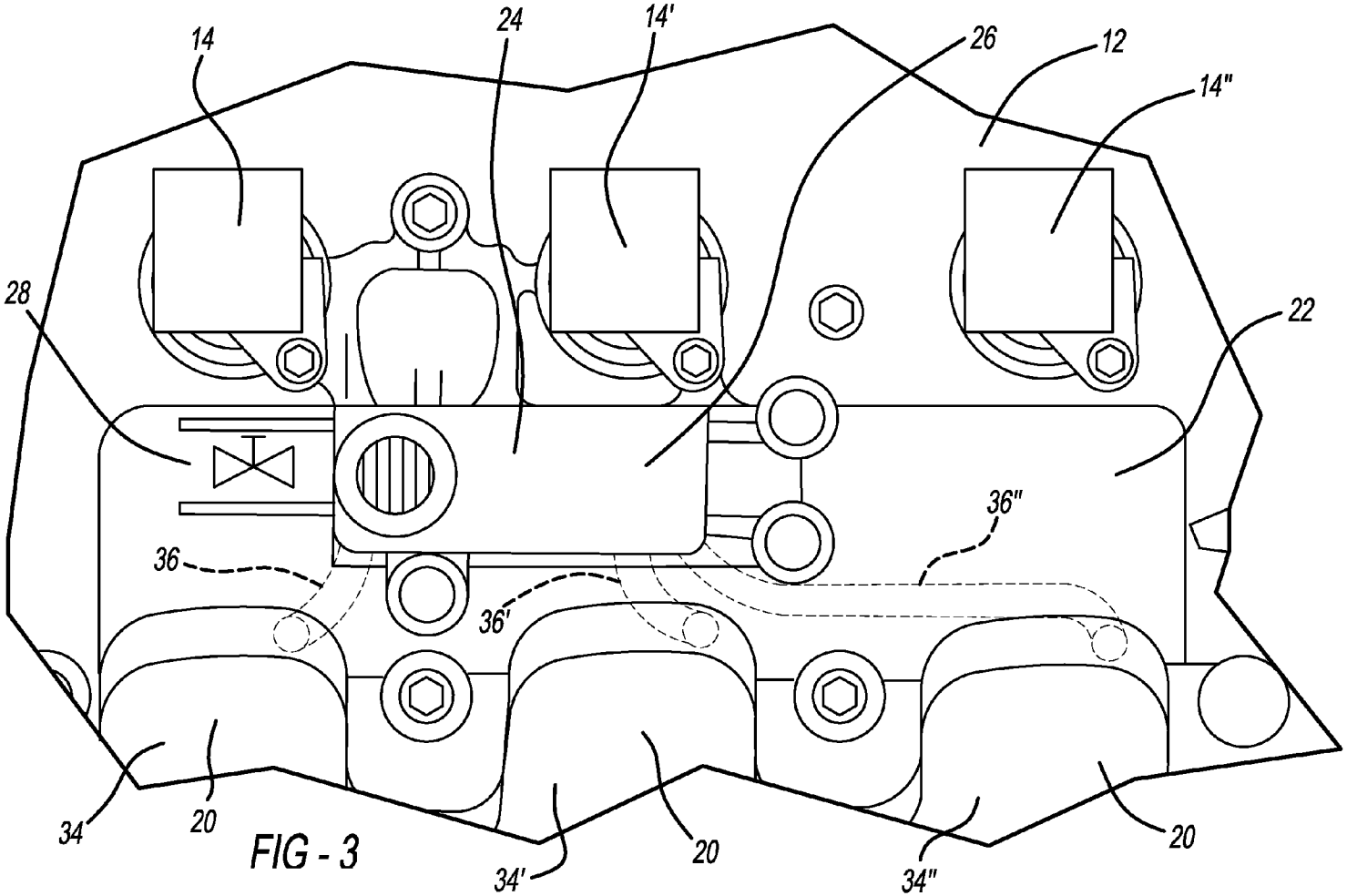
FIG. 3 also illustrates a close-up view of a portion of the internal combustion engine illustrated in FIG. 1 in which the PCV intake runner ports and the intake runners are illustrated in broken lines according to another embodiment of the disclosed inventive concept.

Referring to FIG. 3, a close-up view of a portion of the internal combustion engine 10 is illustrated according to another embodiment of the disclosed inventive concept. As is the case with the embodiment illustrated in FIG. 2 and discussed above in conjunction therewith, the manifold chamber 22 is associated with the PCV regulator valve 28 such that an intake runner port directs gases from the crankcase to one or more intake runners. As shown, each of three PCV intake runner ports 36, 36' and 36" is connected at one end to the PCV oil separator 26. The three PCV intake runner ports 36, 36' and 36" are associated with a like number of intake runners 34, 34' and 34" The PCV intake runner ports 36, 36' and 36" are integrally formed within the cam cover 12.

Figure 4:
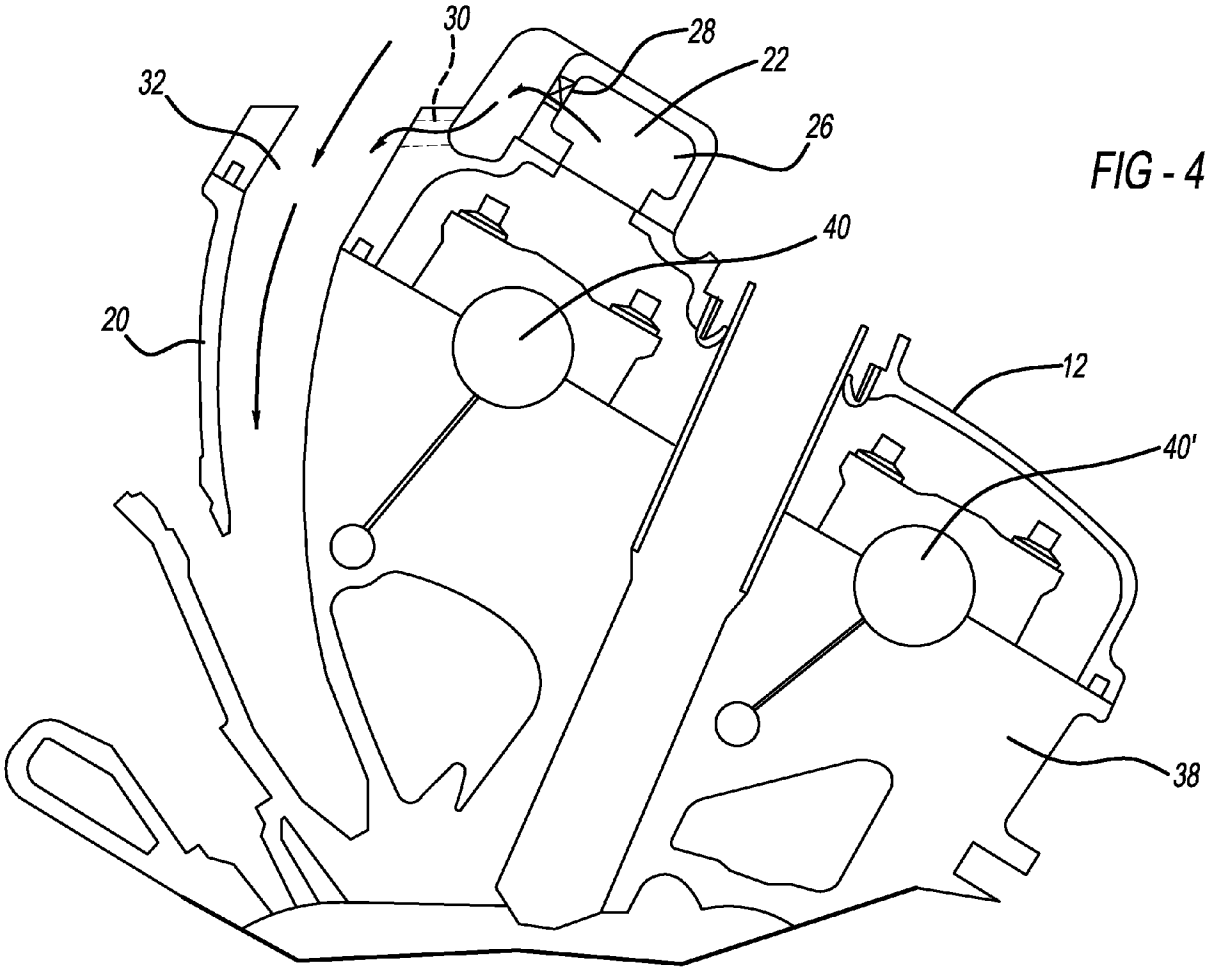
FIG. 4 is a cut-away section of a portion of the engine depicted in FIG. 1 taken along a plane perpendicular to the long axis of the crankshaft.

FIG. 4 illustrates a cut-away section of a portion of the internal combustion engine 10 depicted in FIGS. 1, 2 and 3 in which a cylinder head 38 is shown as are a pair of spaced apart cam shafts 40 and 40'. The view shown in FIG. 4 is taken along a plane perpendicular to the long axis of the cam shafts 40 and 40'. The relationship between the manifold chamber 22, the oil separator 26, the PCV valve 28, the PCV intake runner port 30 and the intake runner 32 is illustrated in this figure.

In addition to the embodiment of a single port connecting the manifold chamber 22 and to the illustrated embodiment of separate PCV intake runner ports associated with a like number of intake runners, a single runner port may be associated with the manifold chamber 22 and may be connected with a manifold such that two or more intake runners are provided associated with the single port. According to this approach, the crankcase gases can be ported into some or all of the intake runners.

Regardless of the embodiment, by integrating the intake manifold ports and PCV passages with the cam cover, several advantages are achieved over the prior art. The disclosed inventive concept eliminates known external hoses now fitted between the air/oil separator and the intake manifold. The disclosed inventive concept also eliminates two external PCV hose connections provided on the cam cover and on the intake manifold in today's vehicles. By eliminating the external hoses and connections, the joints on the PCV are eliminated that contribute to evaporative emissions. The risk of system failure related to the use of external components is also avoided by integrating the ports and passages into the cam cover. Elimination of the hoses and connectors also reduces assembly time and reduces overall vehicle weight.

The disclosed invention as set forth above overcomes the challenges faced by known positive crankcase ventilation (PCV) systems by providing an internal combustion engine having intake manifold ports and PCV passages integrated into the cam cover, thus resulting in both PCV separation and distribution being completely contained within the cam cover. However, one skilled in the art will readily recognize from such discussion, and from the accompanying drawings and claims that various changes, modifications and variations can be made therein without departing from the true spirit and fair scope of the invention as defined by the following claims.

What is claimed is:

1. An engine system comprising:

an elongated cam cover having a long axis, side walls and a top wall, said top wall having a PCV opening formed therein;

a PCV intake runner manifold and an elongated PCV intake runner port connected to said runner manifold, said runner manifold and said runner port being integrally formed within said cover, said elongated runner port being formed along said long axis of said cam cover;

a PCV valve having a bottom wall, said bottom wall having a cam cover opening formed therein, said PCV valve being attached to said top wall of said cam cover such that said PCV opening and said cam cover opening are in fluid communication; and an intake manifold having plural intake runners, said intake runners being connected to said runner port.

2. The engine system of claim 1 further including a PCV oil separator associated with said PCV valve.

3. The engine system of claim 2 wherein said oil separator is fitted between said passage and said PCV valve.

4. The engine system of claim 2 wherein said oil separator is mounted on said cam cover.

5. The engine system of claim 2 further including a manifold chamber, said PCV oil separator being associated with said manifold chamber.

6. The engine system of claim 2 wherein said PCV valve is integrated with said oil separator.

7. An engine system comprising:

an elongated cam cover having a long axis, side walls and a top wall, said top wall having a PCV opening formed therein and having an elongated, internal, gas-passing passage having an input end and an output end, said elongated gas-passing passage being formed along said long axis of said cam cover;

a PCV valve having a bottom wall, said bottom wall having a cam cover opening formed therein, said PCV valve being attached to said top wall of said cam cover such that said PCV opening and said cam cover opening are in fluid communication, said valve being attached directly to said input end of said passage;

an oil separator associated with said PCV valve; and an intake manifold having plural intake runners, said runners having an input port, said port being attached directly to said output end of said passage.

8. The engine system of claim 7 wherein said oil separator is fitted between said passage and said PCV valve.

9. The engine system of claim 7 wherein said oil separator is mounted on said cam cover.

10. The engine system of claim 7 further including a manifold chamber, said PVC oil separator being associated with said manifold chamber.

11. The engine system of claim 7 wherein said PCV valve is integrated with said oil separator.

12. An engine system comprising:

an elongated cam cover having a long axis, side walls and a top wall, said top wall having a PCV opening formed therein and having an elongated, internal, gas-passing passage, said passage having first and second ends, said elongated gas-passing passage being formed along said long axis of said cam cover;

a PCV regulator having a bottom wall, said bottom wall having a cam cover opening formed therein, said PCV valve being attached to said top wall of said cam cover such that said PCV opening and said cam cover opening are in fluid communication, said valve being directly connected to said first end of said passage;

an oil separator associated with said PCV regulator; and an intake manifold including plural intake manifold runners having an input port connected directly to said second end of said passage.

13. The engine system of claim 12 wherein said PCV regulator is a PCV valve.

14. The engine system of claim 12 wherein said oil separator is fitted between said passage and said PCV valve.

15. The engine system of claim 12 wherein said oil separator is mounted on said cam cover.

16. The engine system of claim 12 further including a manifold chamber, said PCV oil separator being associated with said manifold chamber.

17. The engine system of claim 12 wherein said PCV valve is integrated with said oil separator.

* * * * *